US010831138B2

(12) United States Patent
Mita

(10) Patent No.: US 10,831,138 B2
(45) Date of Patent: Nov. 10, 2020

(54) FIXING DEVICE, IMAGE FORMING APPARATUS, AND METHOD

(71) Applicant: TOSHIBA TEC KABUSHIKI KAISHA, Tokyo (JP)

(72) Inventor: Katsutoshi Mita, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/799,094

(22) Filed: Feb. 24, 2020

(65) Prior Publication Data

US 2020/0192254 A1 Jun. 18, 2020

Related U.S. Application Data

(63) Continuation of application No. 16/270,128, filed on Feb. 7, 2019, now Pat. No. 10,613,457.

(30) Foreign Application Priority Data

Jul. 6, 2018 (JP) ..... 2018-129149

(51) Int. Cl.
*G03G 15/20* (2006.01)

(52) U.S. Cl.
CPC ..... *G03G 15/205* (2013.01); *G03G 15/2039* (2013.01)

(58) Field of Classification Search
CPC ..... G03G 15/205; G03G 15/2039
See application file for complete search history.

(56) References Cited

U.S. PATENT DOCUMENTS

| | | | |
|---|---|---|---|
| 10,474,072 | B2 | 11/2019 | Mita |
| 2005/0214013 | A1 | 9/2005 | Gilmore |
| 2013/0195494 | A1 | 8/2013 | Asami et al. |
| 2018/0032008 | A1 | 2/2018 | Sako et al. |

*Primary Examiner* — Sophia S Chen
(74) *Attorney, Agent, or Firm* — Kim & Stewart LLP

(57) ABSTRACT

According to one embodiment, a fixing device includes a heating rotator to contact a medium, such as a sheet of paper, on which a toner image has been disposed. A heater is inside the heating rotator to heat the medium. A pressurizing rotator is configured to press against the heating rotator to form a nip through which the medium passes. A controller is configured to drive the heater to heat the heating rotator to a target temperature. The controller is configured to set the target temperature according to a length of a standby time between an end of a first image forming process to a start of a second image forming process after the first image forming process.

19 Claims, 10 Drawing Sheets

FIXING DEVICE, IMAGE FORMING APPARATUS, AND METHOD

CROSS-REFERENCE TO RELATED APPLICATIONS

This application is a continuation of U.S. patent application Ser. No. 16/270,128, filed on Feb. 7, 2019, which is based upon and claims the benefit of priority from Japanese Patent Application No. 2018-129149, filed Jul. 6, 2018, the entire contents of each of which are incorporated herein by reference.

FIELD

Embodiments described herein relate generally to a fixing device, an image forming apparatus, and a method.

BACKGROUND

An image forming apparatus, such as a multi-function peripheral or a laser printer, includes a fixing device for fixing a toner image on a sheet. By transmitting heat from a heater to the sheet through, for example, a fixing belt, the fixing device fixes a toner image onto the sheet.

In the fixing device, when an image forming process is repeatedly performed, the temperature of components of the fixing device, such as the fixing belt, can be increased. Heat is removed from the fixing belt mainly by transfer of heat to sheets passing through the fixing device. Therefore, the temperature of the sheet passing area of the fixing belt which is in contact with the sheet is lowered, but the temperature of a non-sheet passing area (an area of the fixing belt which is not in contact with the sheet) remains high. When the temperature of the non-sheet passing area remains high, printing/fixing can be performed sufficiently merely by supplying power to the heater corresponding to the amount of heat transmitted from the sheet passing area to the sheet. Therefore, a technique for controlling the temperature of the heater in the image forming apparatus on the basis of the temperature of the sheet passing area and the temperature of the non-sheet passing area has been proposed.

On the other hand, when the image forming apparatus is stopped for a long time or when the interval between printings is lengthy, the temperature of the various components of the fixing device decreases. In this lowered temperature state, the heat of the heater must also flow to the surrounding components, such as the non-sheet passing area of the fixing belt, in addition to the sheet passing area. In order to perform printing in such a case, it is necessary to determine the heating requirement of the fixing belt by taking into consideration the amount of heat moving from the sheet passing area to the surrounding components.

DETAILED DESCRIPTION

An embodiment controls a temperature of a fixing device by taking into consideration an interval between image formation processes of an image forming apparatus.

In general, according to one embodiment, a fixing device comprises a heating rotator to contact a medium, such as a sheet of paper or the like, on which a toner image has been disposed. A heater is inside the heating rotator to heat the medium through the heating rotator. A pressurizing rotator, such as a press roller or the like, is configured to press against the heating rotator to form a nip through which the medium passes. A controller is configured to drive the heater to heat the heating rotator to a target temperature. The controller is configured to set the target temperature according to a length of a standby time interval between an end of a first image forming process to a start of a second image forming process after the first image forming process.

Hereinafter, an image forming apparatus according to an embodiment will be described with reference to the drawings. In the description, an XYZ coordinate system configured with X axis, Y axis, and Z axis which are perpendicular to each other is used for convenience of description.

Figure 1:
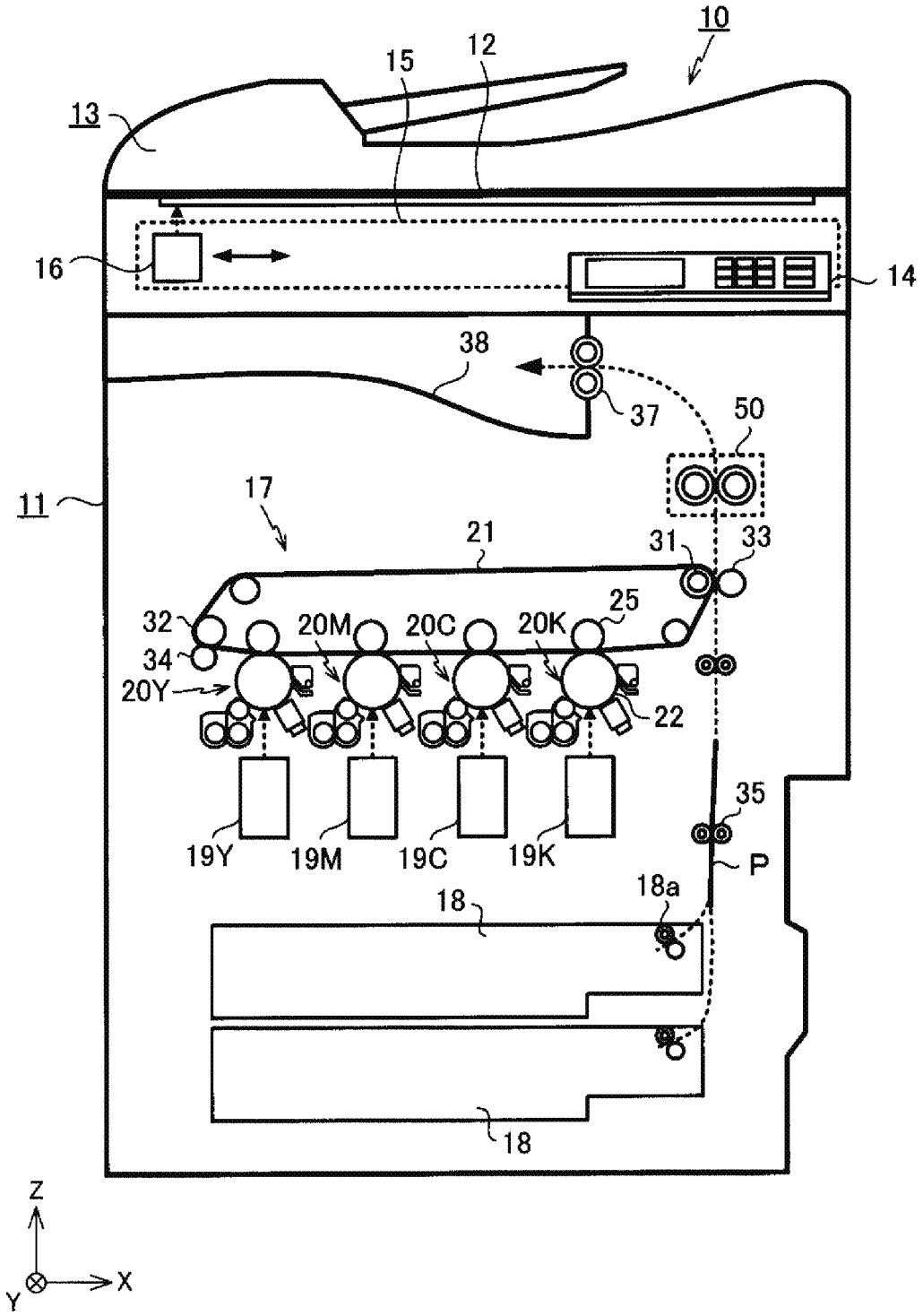
FIG. 1 is a diagram schematically illustrating a configuration of an image forming apparatus according to an embodiment.

FIG. 1 is a diagram schematically illustrating a configuration of an image forming apparatus 10. The image forming apparatus 10 is, for example, a multi-function peripheral (MFP). The image forming apparatus 10 includes a main body 11 and an automatic document feeder (ADF) 13 disposed above the main body 11. A document platen 12 made of a transparent glass is disposed in an upper portion of the main body 11, and an automatic document feeder (ADF) 13 is provided on the upper surface side of the document platen 12 in a openable manner. In addition, an operation panel 14 is provided in an upper portion of the main body 11. The operation panel 14 has various keys, a graphical user interface (GUI), or the like.

A scanner 15 for reading an original document is provided below the document platen 12. The scanner 15 reads an original document supplied by the automatic document feeder 13 or placed on the document platen 12 and generates image data from the original document. The scanner 15 includes an image sensor 16.

In the case of reading the image of the original document mounted on the document platen 12, the image sensor 16 reads the image of the original document while moving in the +X direction along the document platen 12. In addition, in the case of reading the image of the original document supplied to the document platen 12 by the automatic document feeder 13, the image sensor 16 is fixed at the position illustrated in FIG. 1 and reads the image of the original document sequentially supplied by the automatic document feeder 13.

An image forming unit 17 is disposed inside the main body 11. The image forming unit 17 forms an image on a recording medium, such as a sheet, that can be accommodated in a feed cassette 18 on the basis of the image data read by the scanner 15 or the image data created and supplied by a personal computer or the like.

The image forming unit 17 includes image forming units 20Y, 20M, 20C, and 20K that form an image by using respective toners of yellow (Y), magenta (M), cyan (C), and black (K), scanning heads 19Y, 19M, 19C, and 19K provided correspondingly to the image forming units 20Y, 20M, 20C, and 20K, an intermediate transfer belt 21, and the like.

The image forming units 20Y, 20M, 20C, and 20K are disposed below the intermediate transfer belt 21. In the image forming unit 17, the image forming units 20Y, 20M, 20C, and 20K are disposed from the −X side to the +X side. The scanning heads 19Y, 19M, 19C and 19K are disposed below the image forming units 20Y, 20M, 20C and 20K, respectively.

Figure 2:
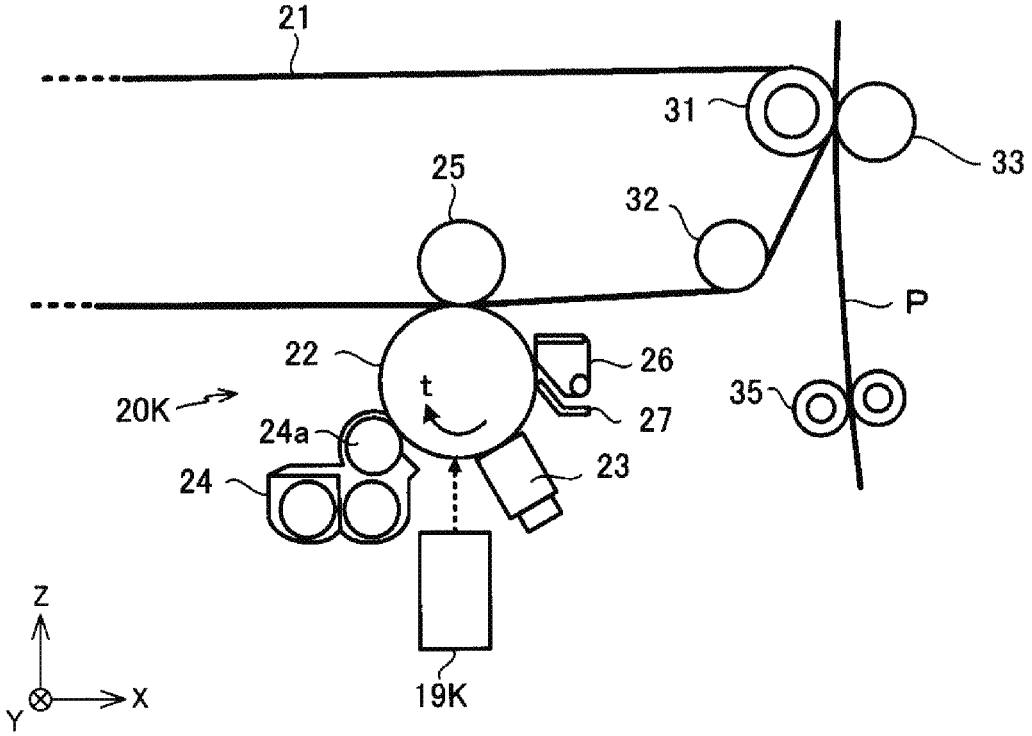
FIG. 2 is an enlarged diagram of an image forming unit.

FIG. 2 is an enlarged diagram of the image forming unit 20K. Each of the image forming units 20Y, 20M, 20C, and 20K has the same configuration. Therefore, the configuration of each image forming unit will be described by reference to the image forming unit 20K as an example.

The image forming unit 20K has a photoconductive drum 22 as an image bearing member. Around the photoconductive drum 22, a charger 23, a developing device 24, a primary transfer roller 25, a cleaner 26, a blade 27, and the like are disposed in the direction indicated by an arrow t. Laser light is irradiated onto an exposure position of the photoconductive drum 22 from the scanning head 19K. An electrostatic latent image is formed on a surface of the photoconductive drum 22 by irradiating the surface of the rotating photoconductive drum 22 with the laser light.

The charger 23 of the image forming unit 20K uniformly charges the surface of the photoconductive drum 22. The developing device 24 supplies toner to the photoconductive drum 22 from a developing roller 24*a* to which a developing bias is applied and develops the electrostatic latent image with adhered toner. The cleaner 26 removes residual toner on the surface of the photoconductive drum 22 by using the blade 27.

As illustrated in FIG. 1, the intermediate transfer belt 21 is stretched around a driving roller 31 and three driven rollers 32. The intermediate transfer belt 21 rotates counterclockwise in FIG. 1 as the driving roller 31 rotates. As illustrated in FIG. 1, the intermediate transfer belt 21 is in contact with the upper surfaces of the photoconductive drums 22 of the image forming units 20Y, 20M, 20C, and 20K. A primary transfer voltage is applied by the primary transfer roller 25 to a position of the intermediate transfer belt 21 that faces each photoconductive drum 22. As a result, the toner image developed on the surface of the photoconductive drum 22 is transferred onto the intermediate transfer belt 21.

A secondary transfer roller 33 is disposed to face the driving roller 31 that stretches the intermediate transfer belt 21. When the sheet P passes between the driving roller 31 and the secondary transfer roller 33, a secondary transfer voltage is applied to the sheet P by the secondary transfer roller 33. As a result, the toner image formed on the intermediate transfer belt 21 is transferred onto the sheet P. A belt cleaner 34 is provided in the vicinity of the driven roller 32 of the intermediate transfer belt 21 as illustrated in FIG. 1. The residual toner on the surface of the intermediate transfer belt 21 is removed by the belt cleaner 34.

As illustrated in FIG. 1, a paper feed roller 35 is provided between the feed cassette 18 and the secondary transfer roller 33. The sheet P is taken out from the feed cassette 18 by a pickup roller 18*a* disposed in the vicinity of the feed cassette 18 and is conveyed between the intermediate transfer belt 21 and the secondary transfer roller 33 by the paper feed roller 35.

A fixing device 50 is provided above the secondary transfer roller 33. A paper discharge roller 37 is provided above the fixing device 50. The sheet P having passed through the intermediate transfer belt 21 and the secondary transfer roller 33 is heated by the fixing device 50. As a result, the toner image is fixed on the sheet P. The sheet P having passed through the fixing device 50 is discharged to a paper discharging unit 38 by the paper discharge roller 37.

Figure 3:
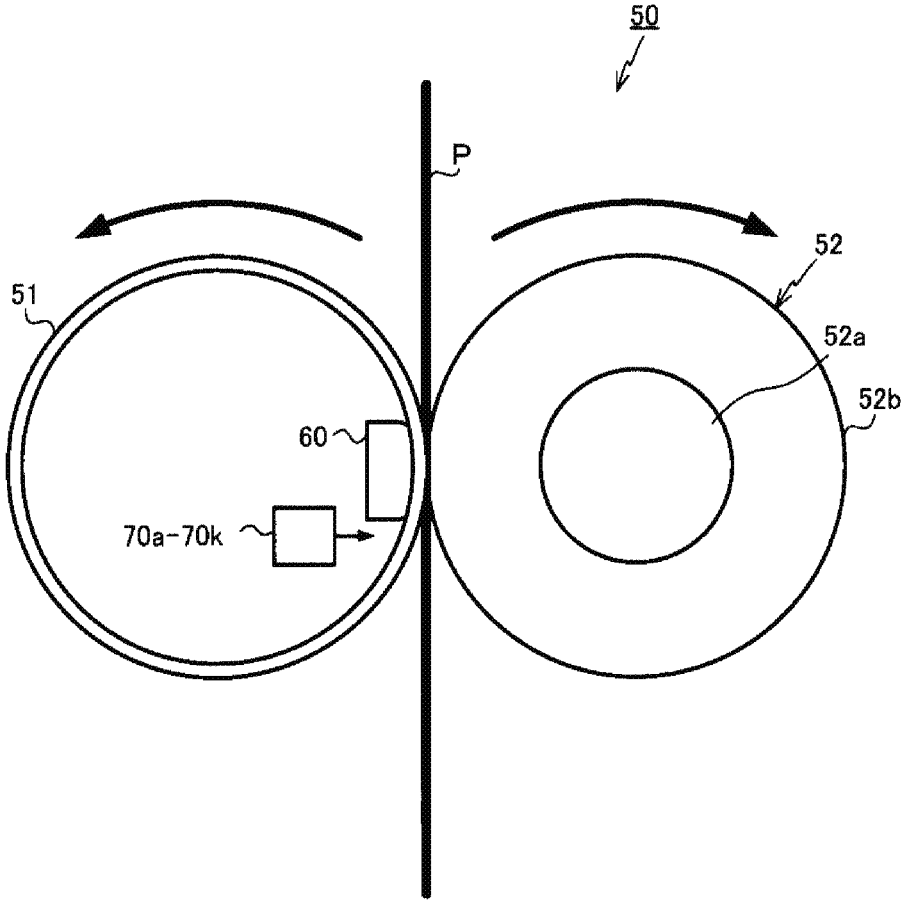
FIG. 3 is a diagram illustrating an example of a fixing device.
Figure 3:
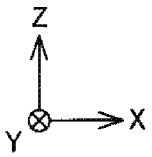

FIG. 3 is a diagram illustrating an example of the fixing device 50. The fixing device 50 includes a fixing belt 51, a pressing roller 52, a heater 60 disposed inside the fixing belt 51, and sensors 70*a* to 70*k*.

The fixing belt 51 is a member having a cylindrical shape of which longitudinal direction is the Y axis direction, and the length of the fixing belt 51 is larger than the width (dimension in the Y axis direction) of the sheet P. With respect to the fixing belt 51, for example, a film made of stainless steel (SUS) having a thickness of 50 μm or polyimide having heat resistance and a thickness of 70 μm is used as a base material. On the surface of the base material, a silicon rubber layer having a thickness of 200 μm is formed. In addition, the silicon rubber layer is covered with a surface protective layer made of a perfluoroalkoxy alkane (PFA) or the like. The fixing belt 51 is supported so as to be rotatable around an axis parallel to the Y axis.

The pressing roller 52 is a columnar member of which the longitudinal direction is the Y-axis direction. The pressing roller 52 includes a core material 52*a* made of a metal such as aluminum and a silicon rubber layer 52*b* stacked on the outer peripheral surface of the core material. The surface of the silicon rubber layer 52*b* is covered with a PFA resin (e.g., perfluoroalkoxy resin). The pressing roller 52 has an outer diameter of about 25 mm and a length substantially equal to the length of the fixing belt 51. The pressing roller 52 is physically biased by an elastic member (not illustrated) in a direction (−X direction) toward the fixing belt 51. As a result, the pressing roller 52 is pressed against the heater 60 through the fixing belt 51. As a result, the surface of the pressing roller 52 and the surface of the fixing belt 51 are brought into close contact with each other, so that a nip through which the sheet P passes from the lower side to the upper side (the +Z direction) is formed.

Figure 4:
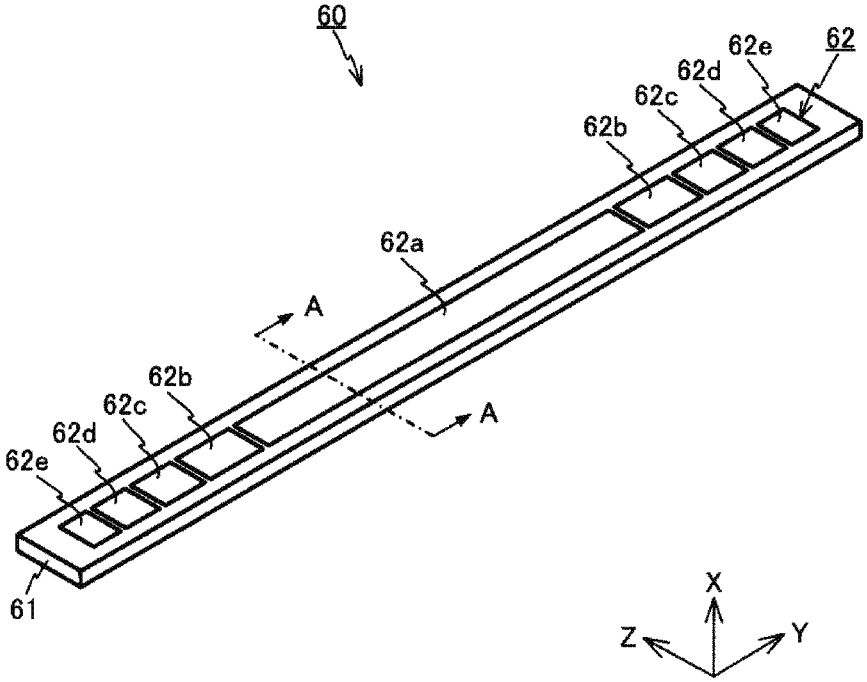
FIG. 4 is a perspective diagram of a heater.

FIG. 4 is a perspective diagram of the heater 60. The heater 60 is a rectangular member of which the longitudinal direction is the Y-axis direction. The heater 60 has a substrate 61 of which the longitudinal direction is also the Y-axis direction. The substrate 61 has an upper surface 62 and is made of, for example, ceramic.

Figure 5:
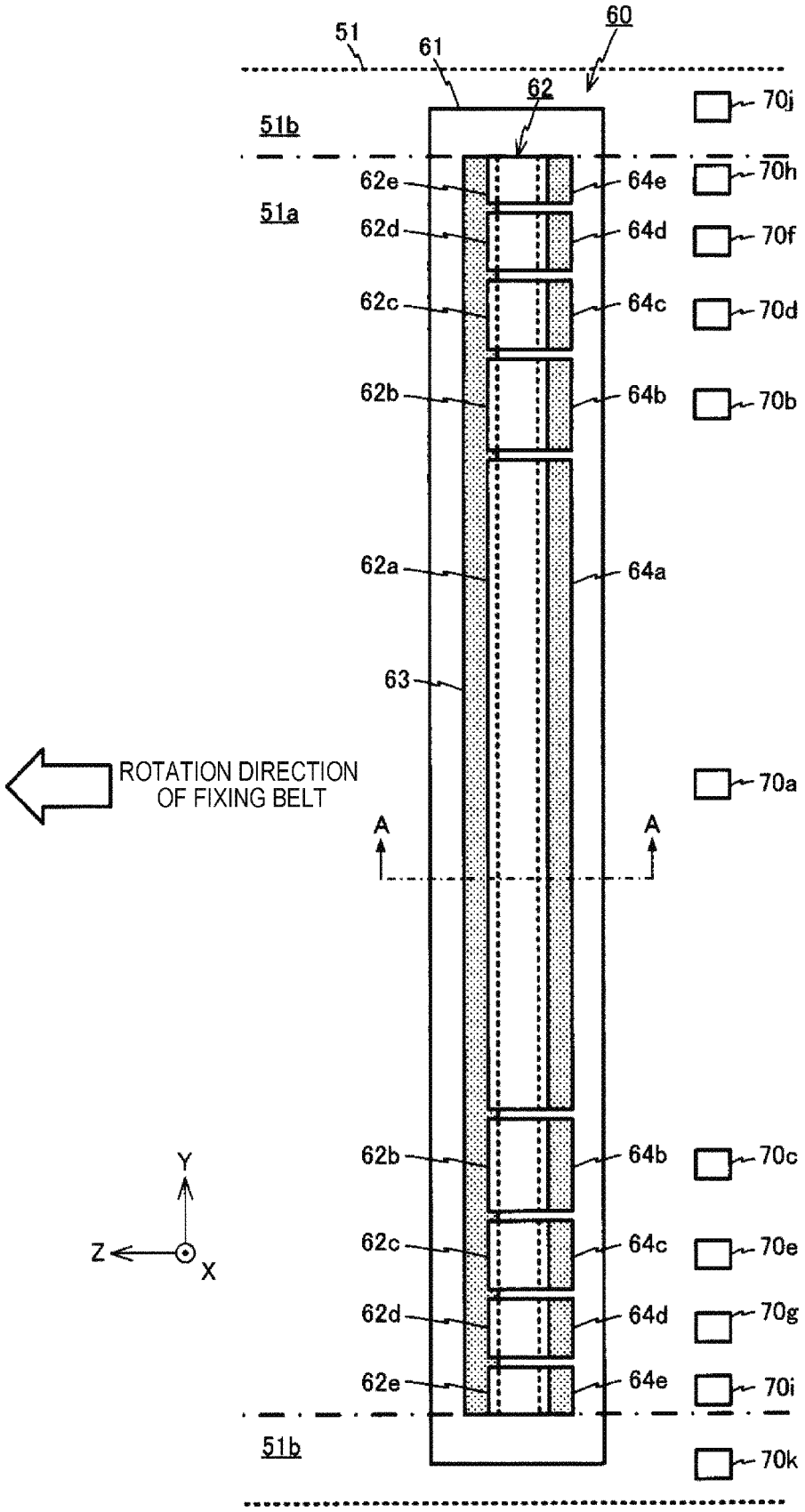
FIG. 5 is a diagram illustrating a heater together with a sensor and a fixing belt.

FIG. 5 is a diagram illustrating the heater 60 together with the sensors 70*a*, 70*b*, 70*c*, 70*d*, 70*e*, 70*f*, 70*g*, 70*h*, 70*i*, 70*j*, 70*k* (70*a* to 70*k*) and the fixing belt 51. As illustrated in FIG. 5, a heating unit 62*a* is formed at the center of the upper surface 62 (the surface on the −X side) of the substrate 61. Heating units 62*b*, 62*c*, 62*d*, and 62*e* are formed in an outwardly progressing order toward the ends of the substrate 61 in the Y axis direction with the heating unit 62*a* as the center. The dimensions of the heating units 62*a* to 62*e* in the Y axis direction are determined on the basis of the size of the sheet P to be used in the image forming apparatus 10. For example, the distance from the −Y side end of the heating unit 62*e* located at the −Y side end of the heater 60 to the +Y side end of the heating unit 62*e* located at the +Y side end of the heater 60 is equal to the length of an A4 size paper in the longitudinal direction. In addition, for example, the distance from the −Y side end of the heating unit 62*d* located at the −Y side end of the heater 60 to the +Y side end of the heating unit 62*d* located at the +Y side end of the heater 60 is equal to the length of a B5 size paper in the longitudinal direction. In this manner, the dimensions of the respective heating units 62*a* to 62*e* are determined on the basis of the expected size (s) of the sheet P. In addition, when an image is formed on the sheet P, the heating units 62*a* to 62*e* can be selectively heated according to the size of the sheet P. The heating units 62*a* to 62*e* are made of a cermet film containing, for example, a TaSiO-based, TaSiNO-based, NbSiO-based, or TiSiCO-based resistive material.

Figure 6:
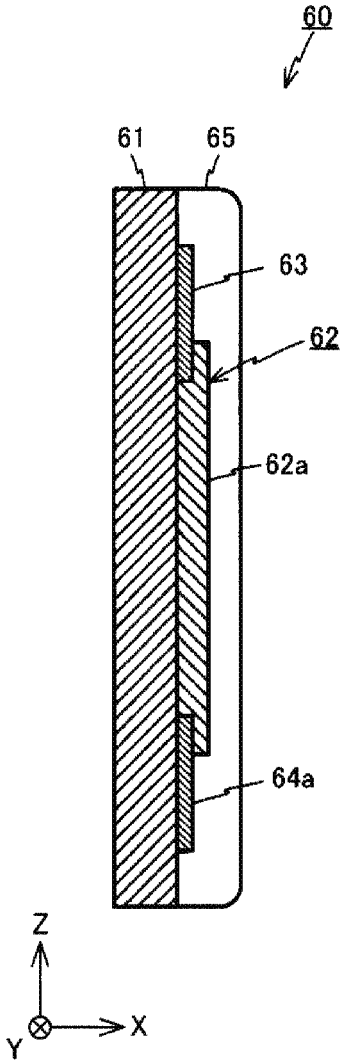
FIG. 6 is a diagram illustrating a cross section of a heater.

The +Z side end portions of the heating units 62*a* to 62*e* are connected to the electrode 63. The −Z side end portions of the heating units 62*a* to 62*e* are connected to the electrodes 64*a* to 64*e*, respectively. The electrodes 63 and 64*a* to 64*e* are made of a metal having a low resistivity, such as copper, for example. FIG. 6 is a diagram illustrating the AA line cross section of the heater 60 in FIG. 5. As can be seen with reference to FIG. 5, the electrode 63 is provided so that the −Z side end portion is located between the heating units 62*a* to 62*e* and the substrate 61. Similarly, the electrodes 64*a* to 64*e* are provided so that the +Z side end portion is located between the heating units 62*a* to 62*e* and the substrate 61.

The heating units 62*a* to 62*e* and the electrodes 63 and 64*a* to 64*e* are covered with a glaze layer 65 formed on the +X side surface of the substrate 61. The glaze layer 65 is a protective layer containing, for example, a glass (e.g., $SiO_2$) as a main component.

Figure 7:
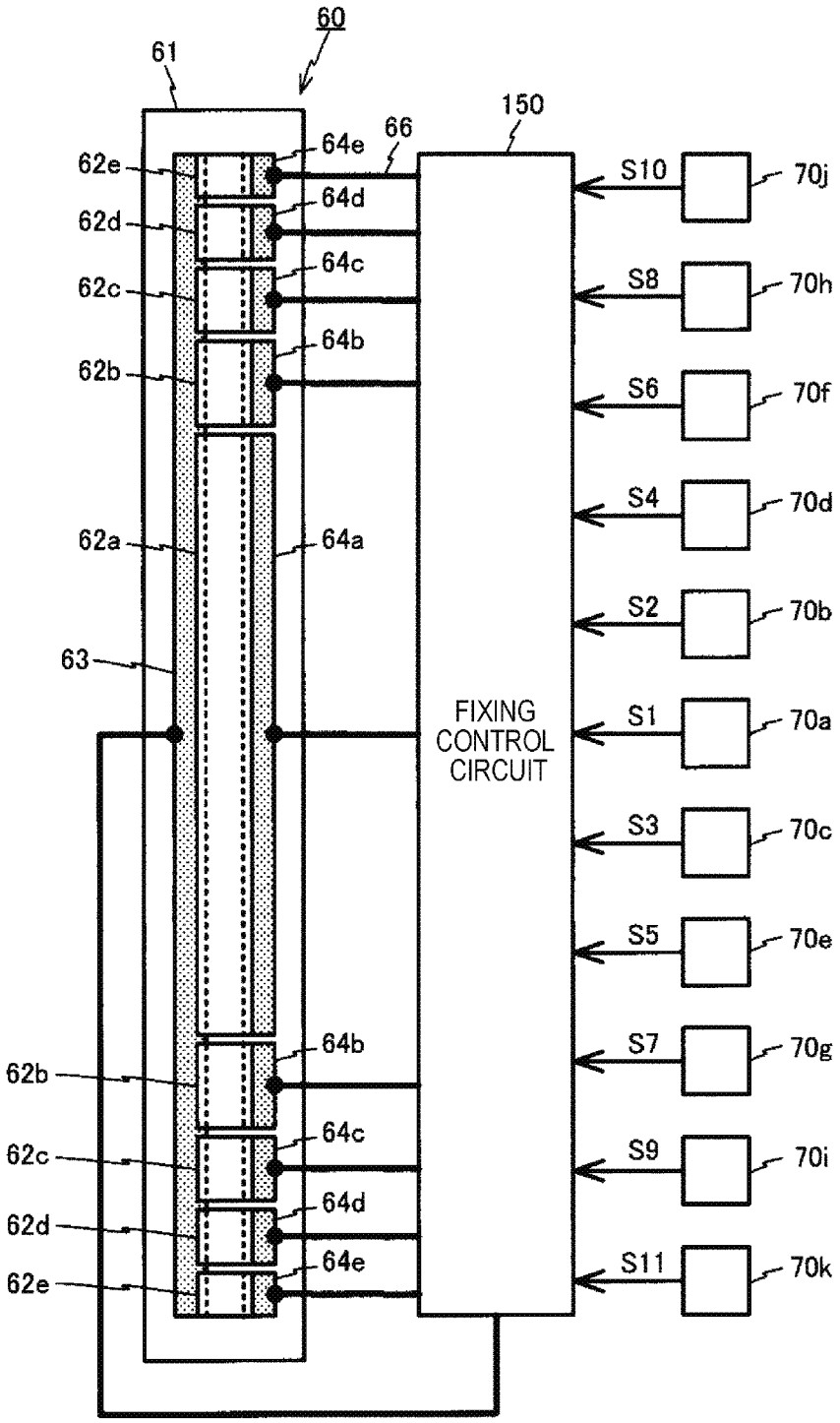
FIG. 7 is a wiring diagram of a heater and a fixing control circuit electrically connected to the heater.

The heater 60 configured as described above is electrically connected to a fixing control circuit 150. FIG. 7 is a wiring diagram of the heater 60 and the fixing control circuit 150 electrically connected to the heater 60. As illustrated in FIG. 7, the electrodes 63 and 64*a* to 64*e* are electrically connected to the fixing control circuit 150 by a wiring 66.

The sensors 70*a* to 70*k* detect the temperature of the fixing belt 51 and output signals S1 to S11 having values corresponding to the detected temperature respectively from the eleven total sensors 70*a* to 70*k*. As illustrated in FIG. 5, the sensor 70*a* is disposed in the vicinity of the heating unit 62*a*. Likewise, the sensors 70*b* and 70*c* are disposed in the vicinity of the heating units 62*b*, respectively. The sensors 70*d* and 70*e* are disposed in the vicinity of the heating units 62*c*, respectively. The sensors 70*f* and 70*g* are disposed in the vicinity of the heating units 62*d*, respectively. The sensors 70*h* and 70*i* are disposed in the vicinity of the heating units 62*e*, respectively. In addition, the sensors 70*j* and 70*k* are disposed near the outer edges of both end portions of the fixing belt 51 in the Y-axis direction.

As illustrated in FIG. 5, in the fixing belt 51, an area overlapping with the heating units 62*a* to 62*e* is a sheet passing area 51*a* through which the sheet P passes, and the other area is a non-sheet passing area 51*b*. Therefore, the temperature of the sheet passing area 51*a* heated by the heating units 62*a* to 62*e* is detected by the sensors 70*a* to 70*g*, and the temperatures of the non-sheet passing area 51*b* are detected by the sensors 70*h* and 70*i*.

The fixing control circuit 150 includes a control system comprising a CPU, a main storage unit, an auxiliary storage unit, and an interface to which the sensors 70*a* to 70*k* are connected and a driving system for driving the heater 60 and the fixing belt 51. The fixing control circuit 150 selectively applies voltages to the electrodes 63 and 64*a* to 64*e* on the basis of the signals S1 to S11 output from the sensors 70*a* to 70*k*. As a result, the heating units 62*a* to 62*e* of the heater 60 selectively generate heat according to the size of the sheet P. Further details of the operations of the fixing control circuit 150 will be described later.

In the above-described fixing device 50, as the pressing roller 52 rotates, the sheet P passes through the nip between the pressing roller 52 and the fixing belt 51 that rotate in the directions indicated by the arrows in FIG. 3, respectively. As a result, the sheet P is heated, and thus, the toner image formed on the sheet P is fixed on the sheet P.

Figure 8:
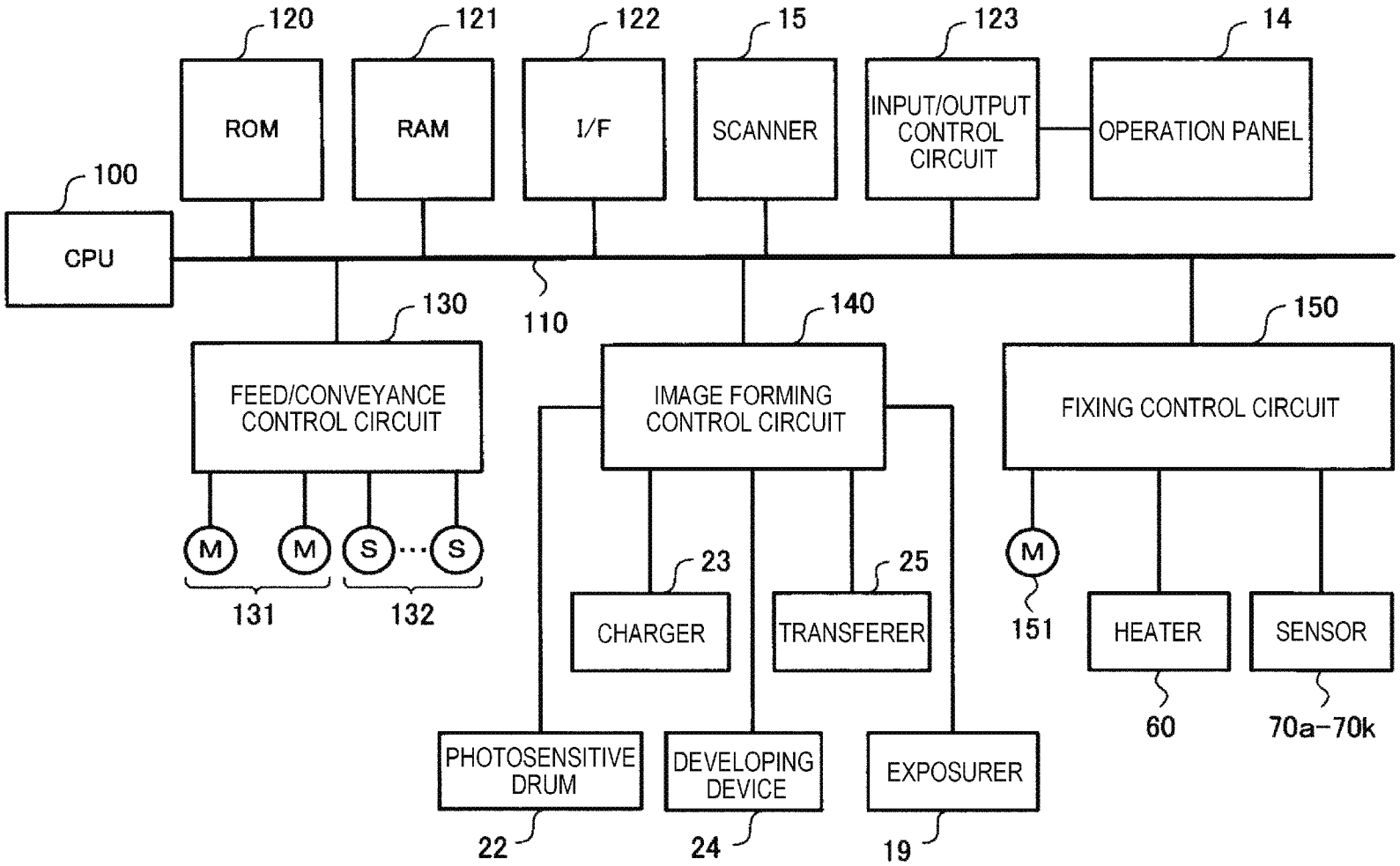
FIG. 8 is a block diagram of a control system of an image forming apparatus.

FIG. 8 is a block diagram of a control system of the image forming apparatus 10. The control system includes, for example, a CPU 100 that controls the entire image forming apparatus, a bus line 110, a read only memory (ROM) 120, a random access memory (RAM) 121, an interface 122, a scanner 15, an input/output control circuit 123, a paper feed/conveyance control circuit 130, an image forming control circuit 140, and a fixing control circuit 150. The CPU 100 and each circuit are connected via the bus line 110.

The ROM 120 stores control programs, control data, and the like that define basic operations of image forming processing.

The RAM 121 functions as a working memory serving as a work area of the CPU 100.

The CPU 100 executes a program stored in the ROM 120. As a result of the program execution, the components of the image forming apparatus 10 are collectively controlled by the CPU 100, and the processes for forming an image on a sheet are executed in sequence.

The interface 122 communicates with a device such as a terminal used by the user. The input/output control circuit 123 displays necessary operation information on the operation panel 14 and receives user input from the operation panel 14. By operating the operation panel 14, for example, the user of the image forming apparatus 10 can designate a paper size, the number of copies of an original document, and the like.

The paper feed/conveyance control circuit 130 is a unit that controls a motor group 131 that drives the pickup roller 18*a*, the paper feed roller 35, the paper discharge roller 37 of the conveying path, and the like. The paper feed/conveyance control circuit 130 controls the motor group 131 according to the detection result of the sensors 132 provided in the vicinity of the paper feed cassette 18 and/or in the conveyance path and the like, on the basis of control signals from the CPU 100.

The image forming control circuit 140 controls the photoconductive drums 22, the chargers 23, the scanning heads 19Y, 19M, 19C, and 19K, the developing devices 24, and the primary transfer rollers 25, respectively, on the basis of control signals from the CPU 100.

The fixing control circuit 150 controls a driving motor 151 that rotates the pressing roller 52 of the fixing device 50 on the basis of control signals from the CPU 100. In addition, the fixing control circuit 150 drives the heater 60 on the basis of outputs from the sensors 70*a* to 70*k*, the size of the sheet P notified from the CPU, and the like.

In the image forming apparatus 10, an image forming process or the like for performing printing on the sheet P is performed according to a print command from the user. The image forming process is performed, for example, in the case of printing the image data received through the interface 122 or in the case of printing the image data generated by the scanner 15.

In the image forming process, as illustrated in FIG. 1, the sheet P is drawn out from the feed cassette 18 by the pickup roller 18*a* and is conveyed between the intermediate transfer belt 21 and the secondary transfer roller 33 by the paper feed roller 35.

In parallel with the above operation, toner images are formed on the photoconductive drums 22 in the image forming units 20Y, 20M, 20C, and 20K. The toner images formed on the photoconductive drums 22 of the image forming units 20Y, 20M, 20C, and 20K are sequentially transferred onto the intermediate transfer belt 21. As a result, a toner image made of a yellow (Y) toner, a magenta (M) toner, a cyan (C) toner, and a black (K) toner is formed on the intermediate transfer belt 21.

When the sheet P passes through the intermediate transfer belt 21 and the secondary transfer roller 33, the toner image formed on the intermediate transfer belt 21 is transferred to the sheet P. As a result, the toner image made of the yellow (Y), magenta (M), cyan (C), and black (K) toners is formed on the sheet P.

The sheet P on which the toner image has been formed then passes through the fixing device 50. At this time, the fixing control circuit 150 selects the heating units 62*a* to 62*e* to be turn on (supplied with electrical power) according to the size of the sheet P. The fixing control circuit 150 receives the signals S1 to S9 output from the sensors 70*a* to 70*i* and sets the target temperature of the fixing belt 51 while monitoring the temperatures of the heating units 62*a* to 62*e*.

For example, in a case where the temperature of the entire fixing device 50 is low, this target temperature is set to be high, and in a case where the temperature of the entire fixing device 50 is high (due to repetitive execution of printing process or the like), the target temperature is set to be low.

The fixing control circuit 150 applies voltages to the heating units 62*a* to 62*e* selected according to the size of the sheet P to generate heat in the heating units 62*a* to 62*e* and heats the fixing belt 51 until the temperature thereof reaches the target temperature. The sheet P is heated while passing through the fixing device 50. As a result, the toner image is fixed on the sheet P so that an image is fixed on the sheet P. The sheet P on which the image has been fixed is discharged to the paper discharging unit 38 by the paper discharge roller 37.

The image forming process described above is executed a number of times according to the print or copy job instructions. For example, when there are a plurality of sheets to be printed in one job, the image forming process is executed a plurality of times. In addition, in the image forming apparatus 10, when an image forming process for another job is performed after the image forming process of a previous job is performed, the control of the fixing device is performed according to the length of time from the end of the previous job to the start of the next job. Hereinafter, a process for executing the second and subsequent jobs after the activation of the image forming apparatus 10 will be described with reference to FIG. 9.

Figure 9:
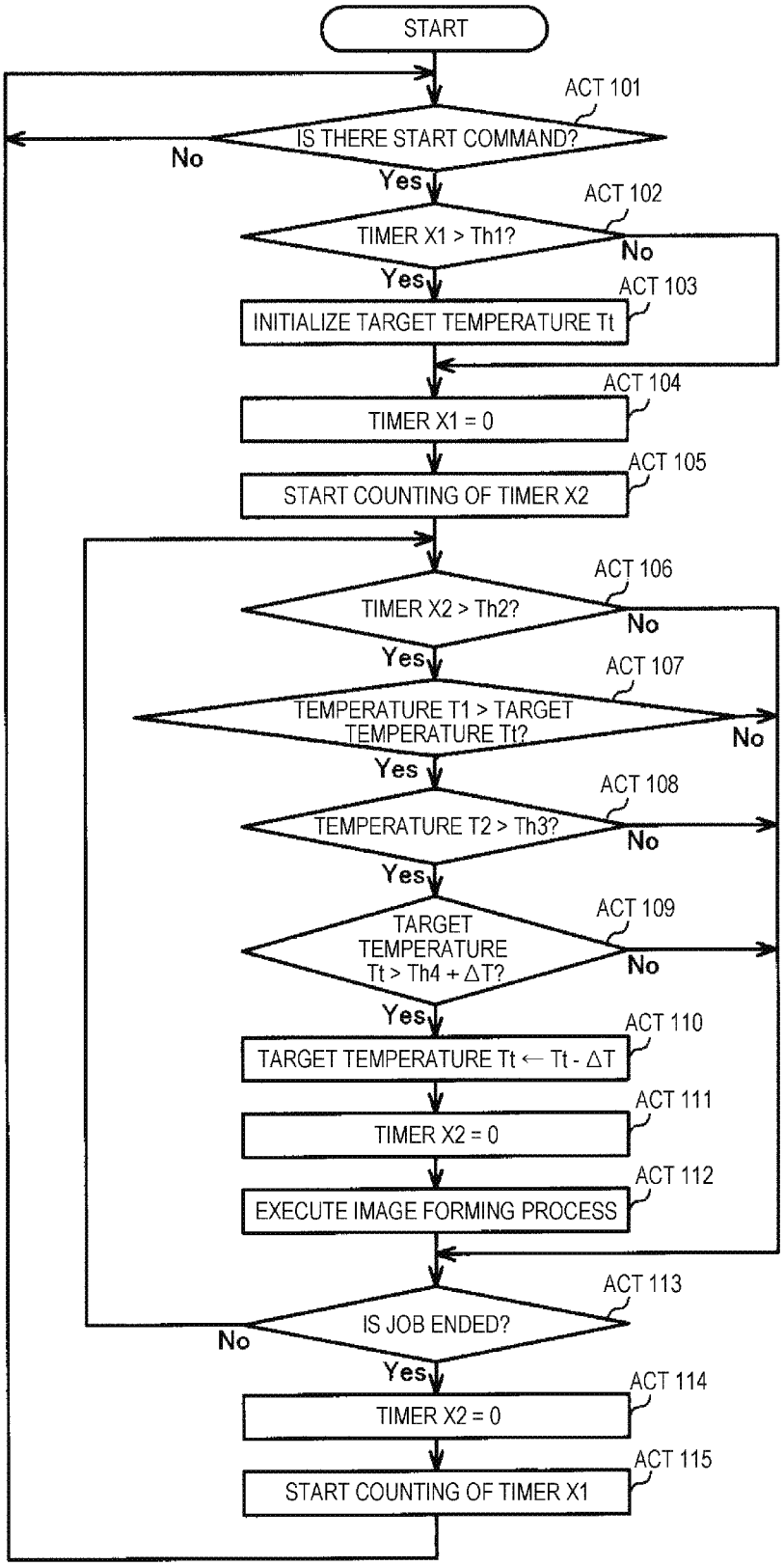
FIG. 9 is a flowchart illustrating processes executed by a fixing control circuit.

FIG. 9 is a flowchart illustrating a series of processes executed by the fixing control circuit 150 when second and subsequent jobs are executed after a first job. The fixing control circuit 150 controls the fixing device according to the flowchart of FIG. 9 in executing the second and subsequent jobs. The processes illustrated in the flowchart of FIG. 9 are executed by the fixing control circuit 150 according to a program stored in advance.

First, the fixing control circuit 150 waits for a job start command from the CPU 100 (ACT 101). When a command to copy an original document is input through the operation panel 14 or an image data transmitted from a device such as a terminal used by the user is received, the CPU 100 outputs the job start command to the fixing control circuit 150. Upon receiving the job start command (ACT 101: Yes), the fixing control circuit 150 determines whether or not a timer X1 exceeds a threshold value Th1 (ACT 102).

The timer X1 is a timer which has counted from the time at which a previous job ended. When it is determined that the timer X1 exceeds the threshold value Th1, this means a time elapsed between print jobs has exceeded a certain time (threshold value Th1) and is considered a long time. If the timer X1 does not exceed the threshold value Th1, then the time elapsed between jobs is considered a short time. The value of the threshold value Th1 is determined on the basis of a heat capacity of the fixing device 50 and is, for example, about 1 to 5 minutes.

In a case where it is determined that the timer X1 exceeds the threshold value Th1 (ACT 102: Yes), the fixing control circuit 150 initializes the target temperature Tt (ACT 103). As a result, the target temperature Tt is set to an initial value. The initial value of the target temperature is determined on the basis of the heat capacity or the like of the fixing device 50 and is, for example, about 140° C. to 170° C.

In ACT 103, in a case where it is determined that the timer X1 does not exceed the threshold value Th1 (ACT 102: No), in a case where the fixing control circuit 150 initializes the target temperature Tt (ACT 103), the fixing control circuit 150 also resets the value of the timer X1 to zero and ends counting of the timer X1 for now (ACT 104). Then, counting of the timer X2 is re-started (ACT 105).

The timer X2 is a timer for counting the time until the target temperature Tt is changed after the target temperature Tt, is previously set. After the timer X2 starts counting (ACT 105), the fixing control circuit 150 checks whether or not the timer X2 exceeds the threshold value Th2 (ACT 106). The threshold value Th2 is determined on the basis of the heat capacity of the fixing device 50, and is, for example, about 1 minute to 2 minutes.

Immediately after the start of the job or when the number of printed sheets corresponding to the job is small, the determination in ACT 106 will be negative (ACT 106: No). On the other hand, if the number of printed sheets corresponding to the job is large and a certain period of time has elapsed since the start of the job, the determination in ACT 106 will be affirmative (ACT 106: Yes).

In a case where it is determined that the timer X2 exceeds the threshold value Th2 (ACT 106: Yes), the fixing control circuit 150 next determines whether or not the temperature T1 of the sheet passing area 51*a* of the fixing belt 51 exceeds the target temperature Tt (ACT 107). More specifically, the fixing control circuit 150 compares the temperatures TS1 to TS9 respectively indicated by the signals S1 to S9 from the sensors 70*a* to 70*i* with the target temperature Tt. When any one of the temperatures TS1 to TS9 exceeds the target temperature Tt, it is determined that the temperature T1 of the sheet passing area 51*a* exceeds the target temperature Tt (ACT 107: Yes).

In a case where it is determined that the temperature T1 of the sheet passing area 51*a* exceeds the target temperature Tt, the fixing control circuit 150 next determines whether or not the temperature T2 of the non-sheet passing area 51*b* of the fixing belt 51 exceeds the threshold value Th1 (ACT 108). More specifically, the fixing control circuit 150 compares the temperatures TS10 and TS11 respectively indicated in the signals S10 and S11 from the sensors 70*j* and 70*k* with the threshold value Th3. When any one of the temperatures TS10 and TS11 exceeds the threshold value Th3, it is determined that the temperature T2 of the non-sheet passing area 51*b* exceeds the threshold value Th3 (ACT 108: Yes). The threshold value Th3 is determined on the basis of the heat capacity of the fixing device 50 and is, for example, about 150° C. to 200° C.

In a case where it is determined that the temperature T2 of the non-sheet passing area 51*b* exceeds the threshold value Th3, the fixing control circuit 150 next determines whether or not the target temperature Tt is higher than the sum of the threshold value Th4 and a control amount ΔT (ACT 109). The threshold value Th4 indicates the temperature lower limit value of the fixing belt 51. The threshold value Th4 is, for example, about 110° C. to 120° C. In addition, the control amount ΔT indicates a change increment when the target temperature Tt is varied. The control amount ΔT is, for example, about 5° C. to 10° C.

For example, when the determination in ACT 102 is affirmative, the target temperature Tt is initialized (ACT 103). In this case, the target temperature Tt is larger than the sum of the threshold value Th4 indicating the temperature lower limit value and the control amount ΔT. Therefore, it is determined that the target temperature Tt is larger than the sum of the threshold value Th4 and the control amount ΔT (ACT 109: Yes).

In a case where the determination in ACT 109 is affirmative (ACT 109: Yes), the fixing control circuit 150 sets the target temperature Tt obtained by subtracting the control amount ΔT from the current target temperature Tt as a new target temperature (ACT 110). As a result, the target temperature is decreased by the control amount ΔT.

Next, the fixing control circuit 150 resets the timer X2 (ACT 111). As a result, the counting of the elapsed time since the change of the target temperature Tt is re-started.

Next, the fixing control circuit 150 drives the fixing device 50 to fix the toner image onto the sheet P, so that the image forming process is performed (ACT 112). As a result, the toner image is fixed on the sheet P, and thus, printing on the sheet P is executed.

In a case where the fixing of the toner image on one sheet is completed and the image forming process is ended (ACT 112), or in a case where the determination in ACTs 106 to 109 is negative (ACTs 106 to 109: No), the fixing control circuit 150 determines whether or not execution of the printing of the number of sheets corresponding to the job has ended (ACT 113). For example, the CPU 100 outputs a job end command when the execution of printing of the number of sheets corresponding to the job has completed or when the job is otherwise interrupted. Upon receiving the job end command, the fixing control circuit 150 determines that the job has ended.

In a case where it is determined that the job has not ended (ACT 113: No), the fixing control circuit 150 repeatedly executes the processes of ACTs 106 to 112. As a result, every time the determination in ACTs 106 to 109 is affirmative, the target temperature Tt is decreased by the temperature control amount ΔT. Therefore, when printing on the sheet P is performed continuously (or in rapid succession), increasing of the temperature in the non-sheet passing area 51*b* is suppressed, and the temperature of the sheet passing area 51*a* is maintained at an appropriate temperature.

On the other hand, in a case where it is determined that the job has ended (ACT 113: Yes), the fixing control circuit 150 resets the value of the timer X2 to zero and ends the counting of the timer X2 (ACT 114).

Next, the fixing control circuit 150 starts counting of the timer X1 (ACT 115). As a result, a standby time until the next job is started is counted. After that, the fixing control circuit 150 repeatedly executes the processes of ACTs 101 to 115.

As described above, in the fixing device 50 according to this embodiment, the target temperature Tt of the fixing device 50 is changed on the basis of the temperatures T1 and T2 of the sheet passing area 51*a* and the non-sheet passing area 51*b* of the fixing belt 51 (ACT 110). In a case where the count value of the timer X1 is larger than the threshold value Th1 (ACT 102: Yes), the target temperature Tt changed at the time of the preceding job is reset to the initial value (ACT 103). On the other hand, in a case where the count value of the timer X1 is equal to or smaller than the threshold value Th1, the target temperature Tt changed at the time of the preceding job is maintained as it is.

In other words, in a case such as where the standby time from the end of an image forming process to the next image forming process is relatively long and the temperature of the entire fixing device 50 is low, the target temperature Tt is reset to the initial value. However, in a case such as where the standby time is relatively short and the temperature of the entire fixing device 50 is already high, the target temperature Tt is set to a temperature lower than the initial value.

As described above, in a case where the standby time from the end of one job to the next job is long, the target temperature Tt of the fixing device 50 is set to a high value, and in a case where the standby time is short, the target temperature Tt which was changed to a low temperature in a preceding job is maintained, so that the temperature of the fixing device 50 can be maintained at the optimum temperature.

More specifically, when a temperature lower than the initial value is set as the target temperature Tt in the preceding job, in a case where the printing is resumed after a long standby time, the target temperature Tt once set low is re-initialized, and a higher temperature is set as the target temperature Tt. Therefore, it is possible to suppress defective fixing of the toner caused by a decrease in temperature of the sheet passing area 51*a* during a standby period.

In addition, when a temperature lower than the initial value is set as the target temperature Tt in a preceding job, in a case where the next job is to be performed without a lengthy standby time, the target temperature Tt in the preceding job is maintained, so that it is avoided that the fixing device 50 is unnecessarily overheated. Therefore, it is possible to suppress overheating of the non-sheet passing area 51*b* of the fixing belt 51 and suppress sticking occurring between the sheet P and the sheet passing area.

As described above, in the fixing device 50 according to this embodiment, it is possible to accurately fix the toner.

The image forming apparatus 10 according to this embodiment includes the fixing device 50. Therefore, it is possible to form an image with a high accuracy.

An example embodiment of the disclosure has been primarily described above, however, the disclosure is not limited to the above-described embodiment. For example, in the above-described example, the control of the target temperature Tt is performed by taking into consideration the temperature T2 of the non-sheet passing area 51*b* of the fixing belt 51 (ACTs 108 and 110). But the disclosure is not limited thereto, the control of the target temperature Tt may be performed by taking into consideration only the target temperature Tt and the temperature T1 of the sheet passing area 51*a* (ACT 107) without considering the temperature T2 of the non-sheet passing area 51*b*.

In the above-described example, the fixing device 50 is a fixing device of a type in which the sheet P is heated by the heater 60 coupled to the fixing belt 51. But the disclosure is not limited thereto, the fixing device 50 may be a fixing device that heats the fixing belt 51 by using a halogen heater or lamp. In addition, the fixing device 50 may be an induction heating type fixing device that heats the fixing belt 51 by applying a high-frequency current to the fixing belt 51.

In the above-described embodiment, the fixing device 50 includes a cylindrical fixing belt 51. However, the shape of the fixing belt 51 is not limited thereto. For example, as illustrated in FIG. 10, as the fixing device of the image forming apparatus 10, a fixing device 500 including a fixing belt 51 stretched around a plurality of rollers can be used.

Figure 10:
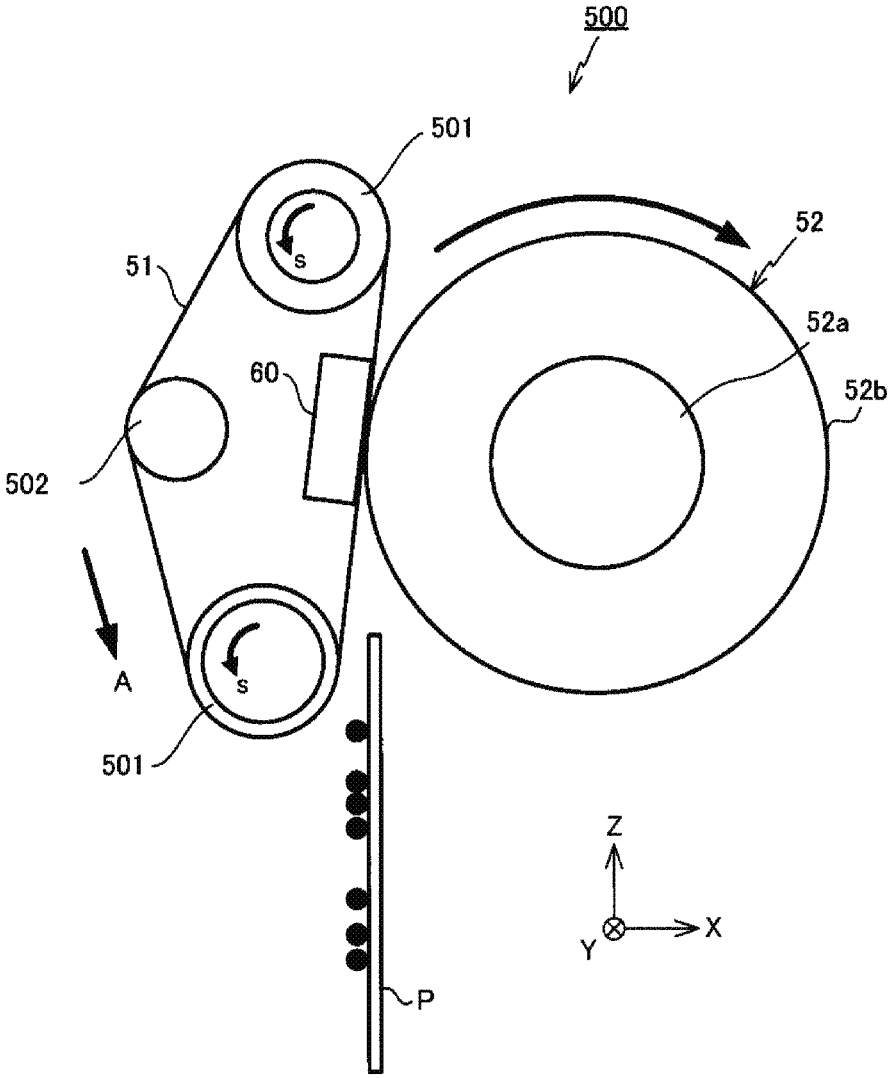
FIG. 10 is a diagram illustrating a fixing device according to a modified example.

As illustrated in FIG. 10, in the fixing device 500, the fixing belt 51 is stretched over a driving roller 501 for rotating the fixing belt 51 and a tension roller 502 for applying tension to the fixing belt 51. The fixing belt 51 rotates in a direction indicated by an arrow A when the driving roller 501 rotates in a direction indicated by an arrow s.

In the fixing device 500, the pressing roller 52 is pressed against the heater 60 in contact with the inside of the fixing belt 51, so that a nip is formed between the fixing belt 51 and the pressing roller 52. As the sheet P passes through the nip, the sheet P is heated by the heater 60 through the fixing belt 51. As a result, the toner image is fixed on the sheet P, and an image is formed on the sheet P.

The case where the image forming apparatus 10 is a multi-function peripheral has been described as an example. But the disclosure is not limited thereto, the image forming apparatus 10 may be a laser printer or the like.

The fixing control circuit 150 of the image forming apparatus 10 executes a series of processes illustrated in the flowchart of FIG. 9. However, the disclosure is not limited thereto, and the CPU 100, which collectively controls the image forming apparatus 10, may execute processes illustrated in the flowchart.

While several embodiments of the present invention have been described, these embodiments have been disclosed as example and are not intended to limit the scope of the present disclosure. Indeed, the novel embodiments can be implemented in various other forms, and various omissions, substitutions, and changes can be made without departing from the spirit of the present disclosure. These embodiments and modifications are included in the scope and spirit of the invention and are included in the claims and the equivalent scope thereof.

What is claimed is:

1. An image forming apparatus, comprising:

a toner image forming unit configured to form a toner image on a transfer belt for transfer to a medium; and a fixing device including:

a heating rotator configured to contact the medium on which the toner image is disposed;

a heater inside the heating rotator to heat the medium through the heating rotator; and a pressurizing rotator configured to press against the heating rotator to form a nip through which the medium passes; and a controller configured to drive the heater to heat the heating rotator to a target temperature, wherein the controller is configured to set the target temperature according to a length of a standby time between an end of a first image forming process to a start of a second image forming process after the first image forming process, the target temperature is controlled by the controller during a fixing of the toner image on the medium to be decreased by a predetermined amount from an initial value, and the controller sets the initial value to the target temperature when the standby time is greater than a threshold value.

2. The imaging forming apparatus according to claim 1, further comprising:

a first sensor configured to detect a temperature of a sheet passing area of the heating rotator, the sheet passing area being an area of the heating rotator contacting the medium during fixing of the toner image on the medium; and a second sensor configured to detect a temperature of a non-sheet passing area of the heating rotator, the non-sheet passing area being an area of the heating rotator not contacting the medium during the fixing of the toner image on the medium.

3. The image forming apparatus according to claim 1, wherein the controller is configured to reset the target temperature to the initial value when the length of the standby time is longer than the threshold value.

4. The image forming apparatus according to claim 1, wherein the heater comprises a plurality of units disposed adjacent to one another along a width direction of the heating rotator.

5. The image forming device according to claim 1, wherein the heating rotator is a fixing belt.

6. The image forming apparatus according to claim 1, wherein the controller leaves the target temperature unchanged when the standby time is less than or equal to a threshold value.

7. An image forming apparatus, comprising:

a toner image forming unit configured to form a toner image on a transfer belt for transfer to a medium; and a fixing device including:

a heating rotator configured to contact the medium on which the toner image is disposed;

a heater inside the heating rotator to heat the medium through the heating rotator; and a pressurizing rotator configured to press against the heating rotator to form a nip through which the medium passes;

a controller configured to drive the heater to heat the heating rotator to a target temperature;

a first sensor configured to detect a temperature of a sheet passing area of the heating rotator, the sheet passing area being an area of the heating rotator contacting the medium during fixing of the toner image on the medium; and a second sensor configured to detect a temperature of a non-sheet passing area of the heating rotator, the non-sheet passing area being an area of the heating rotator not contacting the medium during the fixing of the toner image on the medium, wherein the controller is configured to set the target temperature according to a length of a standby time between an end of a first image forming process to a start of a second image forming process after the first image forming process.

8. The image forming apparatus according to claim 7, wherein the controller leaves the target temperature unchanged when the standby time is less than or equal to a threshold value.

9. The image forming apparatus according to claim 7, wherein the controller sets the initial value to the target temperature when the standby time is greater than the threshold value.

10. The imaging apparatus according to claim 7, wherein the controller decreases the target temperature from the initial value on the basis of temperatures detected by the first sensor and the second sensor.

11. The imaging device according to claim 7, wherein the heating rotator is a fixing belt.

12. The imaging device according to claim 7, wherein the first image forming process is a most recently completed image forming process and the second image forming process is a next image forming process to be carried out.

13. The image forming apparatus according to claim 7, wherein the heater comprises a plurality of units disposed adjacent to one another along a width direction of the heating rotator.

14. A method for fixing a toner image on a medium, the method comprising:

counting a time length between an end of a fixing of the toner image on the medium to a start of a fixing of the toner image on a next medium; and setting a target temperature of a heating rotator for the fixing of the toner image on the next medium on the basis the time length, wherein the target temperature is decreased from an initial value during a fixing of the toner image on the medium and increased when the standby time is greater than a threshold value, and the target temperature is returned to the initial value after any time length greater than the threshold value.

15. The method according to claim 14, wherein the heating rotator is a fixing belt.

16. The method according to claim 14, further comprising:

heating the heating rotator to the target temperature using a heater inside the heating rotator.

17. The method according to claim 14, wherein the medium is a sheet of paper.

18. The method according to claim 14, wherein the target temperature is unchanged when the standby time is less than or equal to the threshold value.

19. The method according to claim 14, wherein the initial value is set to the target temperature when the standby time is greater than the threshold value.

* * * * *